US009764581B2

(12) United States Patent
Murphey et al.

(10) Patent No.: US 9,764,581 B2
(45) Date of Patent: Sep. 19, 2017

(54) SHEET STACKING DEVICE

(71) Applicant: ACCO Brands Corporation, Lake Zurich, IL (US)

(72) Inventors: Ryan G. Murphey, Salem, WI (US); Peter Hotkowski, Chester, CT (US)

(73) Assignee: ACCO Brands Corporation, Lake Zurich, IL (US)

( * ) Notice: Subject to any disclaimer, the term of this patent is extended or adjusted under 35 U.S.C. 154(b) by 472 days.

(21) Appl. No.: 14/227,934

(22) Filed: Mar. 27, 2014

(65) Prior Publication Data

US 2015/0273931 A1 Oct. 1, 2015

(51) Int. Cl.

| | |
|---|---|
| ***B42C 9/00*** | (2006.01) |
| ***B42B 5/06*** | (2006.01) |
| ***B42B 5/08*** | (2006.01) |
| ***B42B 5/10*** | (2006.01) |
| ***B42B 9/00*** | (2006.01) |
| ***B42B 5/12*** | (2006.01) |
| ***B65H 29/24*** | (2006.01) |

(52) U.S. Cl.

CPC ..... *B42B 5/123* (2013.01); *B65H 29/242* (2013.01); *B65H 2301/4212* (2013.01); *B65H 2406/323* (2013.01); *B65H 2801/48* (2013.01)

(58) Field of Classification Search

CPC .... B42C 9/00; B42B 5/00; B42B 5/06; B42B 5/08; B42B 5/10; B42B 9/00

USPC ..... 412/9, 33, 34, 38, 39, 40; 270/52.18, 270/580.07, 58.08

See application file for complete search history.

(56) References Cited

U.S. PATENT DOCUMENTS

| | | | | |
|---|---|---|---|---|
| 4,828,645 | A | 5/1989 | Van Bortel | |
| 4,874,958 | A | 10/1989 | Sampath et al. | |
| 4,905,843 | A | 3/1990 | Holbert | |
| 5,273,370 | A | 12/1993 | Bland et al. | |
| 5,615,986 | A * | 4/1997 | Cox | B42B 5/103 412/40 |
| 5,639,079 | A | 6/1997 | Suzuki et al. | |
| 6,595,511 | B2 | 7/2003 | Goda et al. | |
| 6,863,105 | B2 | 3/2005 | Silverbrook | |
| 6,983,931 | B2 | 1/2006 | Kaneko | |
| 7,104,537 | B2 | 9/2006 | Trovinger et al. | |
| 7,261,507 | B2 | 8/2007 | Horii et al. | |

(Continued)

FOREIGN PATENT DOCUMENTS

| | | |
|---|---|---|
| CA | 1244608 | 11/1988 |
| JP | 2011079607 | 4/2011 |

(Continued)

OTHER PUBLICATIONS

Examination Report from the United Kingdom Intellectual Property Office for Application No. GB1503913.4 dated Apr. 25, 2016 (2 pages).

(Continued)

*Primary Examiner* — R. K. Arundale
*Assistant Examiner* — Justin V Lewis
(74) *Attorney, Agent, or Firm* — Michael Best & Friedrich LLP

(57) ABSTRACT

A sheet stacking device includes a vacuum system that delivers an individual sheet toward a binder element, a sheet deflector element that presses an end of the individual sheet onto the binder element, and a sheet kick-down element that presses the individual sheet away from the vacuum system.

21 Claims, 8 Drawing Sheets

(56) References Cited

U.S. PATENT DOCUMENTS

| | | | | |
|---|---|---|---|---|
| 7,726,928 | B2 | 6/2010 | Kurabayashi et al. | |
| 7,896,330 | B2 | 3/2011 | Kurabayashi et al. | |
| 7,962,088 | B2 | 6/2011 | Sasamoto et al. | |
| 8,123,208 | B2 | 2/2012 | Cracknell et al. | |
| 8,123,209 | B2 | 2/2012 | Kubota et al. | |
| 8,475,107 | B2 | 7/2013 | Haramiishi | |
| 8,485,512 | B2 | 7/2013 | Lewalski et al. | |
| 2005/0265809 | A1* | 12/2005 | Lemens | B26D 7/1863 412/33 |
| 2007/0166130 | A1* | 7/2007 | Kurabayashi | B42B 5/103 412/38 |
| 2009/0148215 | A1 | 6/2009 | Takahashi et al. | |
| 2010/0109313 | A1 | 5/2010 | Fuchs | |
| 2010/0295231 | A1 | 11/2010 | Igata | |
| 2010/0316436 | A1 | 12/2010 | Fuchs | |
| 2011/0110749 | A1 | 5/2011 | Carter et al. | |
| 2012/0275881 | A1 | 11/2012 | Mueller | |
| 2013/0011219 | A1* | 1/2013 | Musha | B42C 19/08 412/16 |
| 2013/0285309 | A1 | 10/2013 | Holland-Letz et al. | |

FOREIGN PATENT DOCUMENTS

| | | |
|---|---|---|
| WO | 2004108428 | 12/2004 |
| WO | 2010139062 | 12/2010 |

OTHER PUBLICATIONS

Combined Search and Examination Report received from the UK IPO for Application No. GB1503913.4, dated Aug. 17, 2015, 6 pages.

* cited by examiner

SHEET STACKING DEVICE

BACKGROUND

The present invention relates to a sheet stacking device, and in particular a sheet stacking device for use in a binding machine.

Binding machines are commonly used to attach a set of sheets together to form a book or booklet. The sheets of paper are either attached with adhesion along edges of the sheets of paper or with a binder element. When attached with a binder element, the binder element is pushed through a set of aligned apertures in a stack of the sheets to bind the stack of sheets together all at once.

SUMMARY

In accordance with one construction, a sheet stacking device includes a vacuum system that delivers an individual sheet toward a binder element, a sheet deflector element that presses an end of the individual sheet onto the binder element, and a sheet kick-down element that presses the individual sheet away from the vacuum system.

In accordance with another construction, a method of stacking sheets includes delivering an individual sheet to a binder element and moving an end of the individual sheet onto the binder element.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
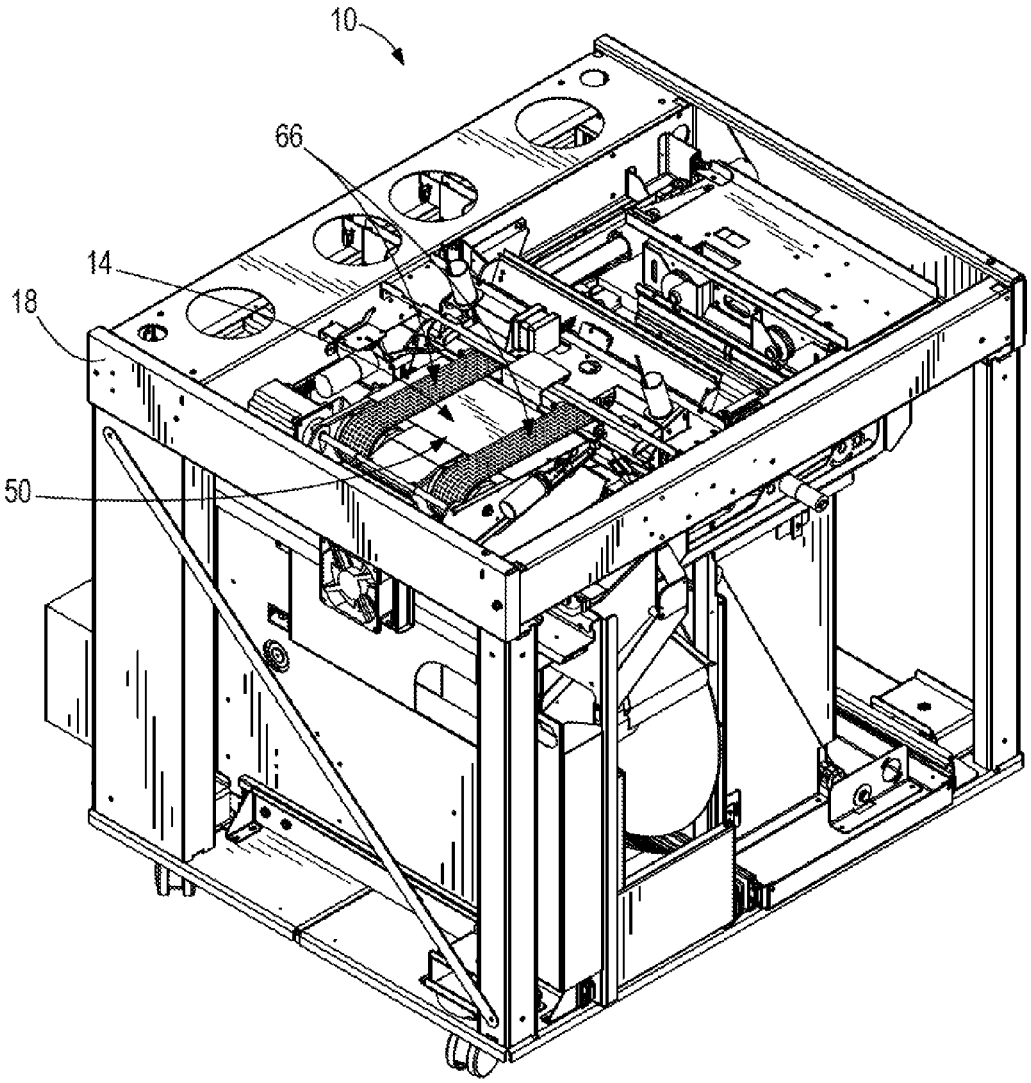
FIG. 1 is a perspective view of a binding machine that includes a sheet stacking device.

FIGS. 1-14 illustrate a binding machine 10 having a sheet stacking device 14 disposed therein. As illustrated in FIG. 1, the machine 10 includes an outer housing 18 that houses the sheet stacking device 14.

With reference to FIGS. 3-14, the sheet stacking device 14 receives an individual sheet 22 from the machine 10. In some constructions the sheet 22 is delivered into the machine 10 from another machine, such as a feeder, printer, scanner, or other machine, prior to being received by the sheet stacking device 14. In some constructions the sheet 22 is delivered by hand and placed into a tray or bin within the machine 10 prior to being received by the sheet stacking device 14. In the illustrated construction the sheet 22 is a sheet of office paper. The sheet 22 includes text, images, and other print thereon (not illustrated). Other constructions include different sizes and types of sheet 22.

With continued reference to FIGS. 3-14, the machine 10 includes a binder element 26 that is used, in conjunction with the sheet stacking device 14, to stack and bind the sheet 22 together with one or more other additional sheets within the machine 10. The illustrated binder element 26 is a twin-loop binder element having a plurality of individual prongs 30 along both a first loop 34 and a second loop 38. The binder element 26 has an open position, as illustrated in FIGS. 3-14, where the first and second loops 34, 38 are pivoted apart from one another for receiving the sheet 22 over the prongs 30, as well as a closed position where the first and second loops 34, 38 are pivoted toward one another for closing off and binding the sheet 22. Other constructions include use of different types of binder elements 26 than that illustrated.

With continued reference to FIGS. 3-14, the binder element 26 is coupled to a binder holding device 42 within the machine 10. The holding device 42 holds the binder element 26 while the binder element 26 is in the open position, and stabilizes the binder element 26 such that the binder element 26 is able to receive the sheet 22. The illustrated holding device 42 includes a series of ridges 46 that restrain and hold a portion of the first loop 34. Other constructions include different types of holding devices 42 other than that illustrated. In some constructions the binder element 26 is one of a plurality of binder elements that are disposed within the machine 10 (e.g., in a container or cartridge) and that are delivered (e.g., with a mechanical arm or other device) to the holding device 42 individually and coupled to the holding device 42.

Figure 2:
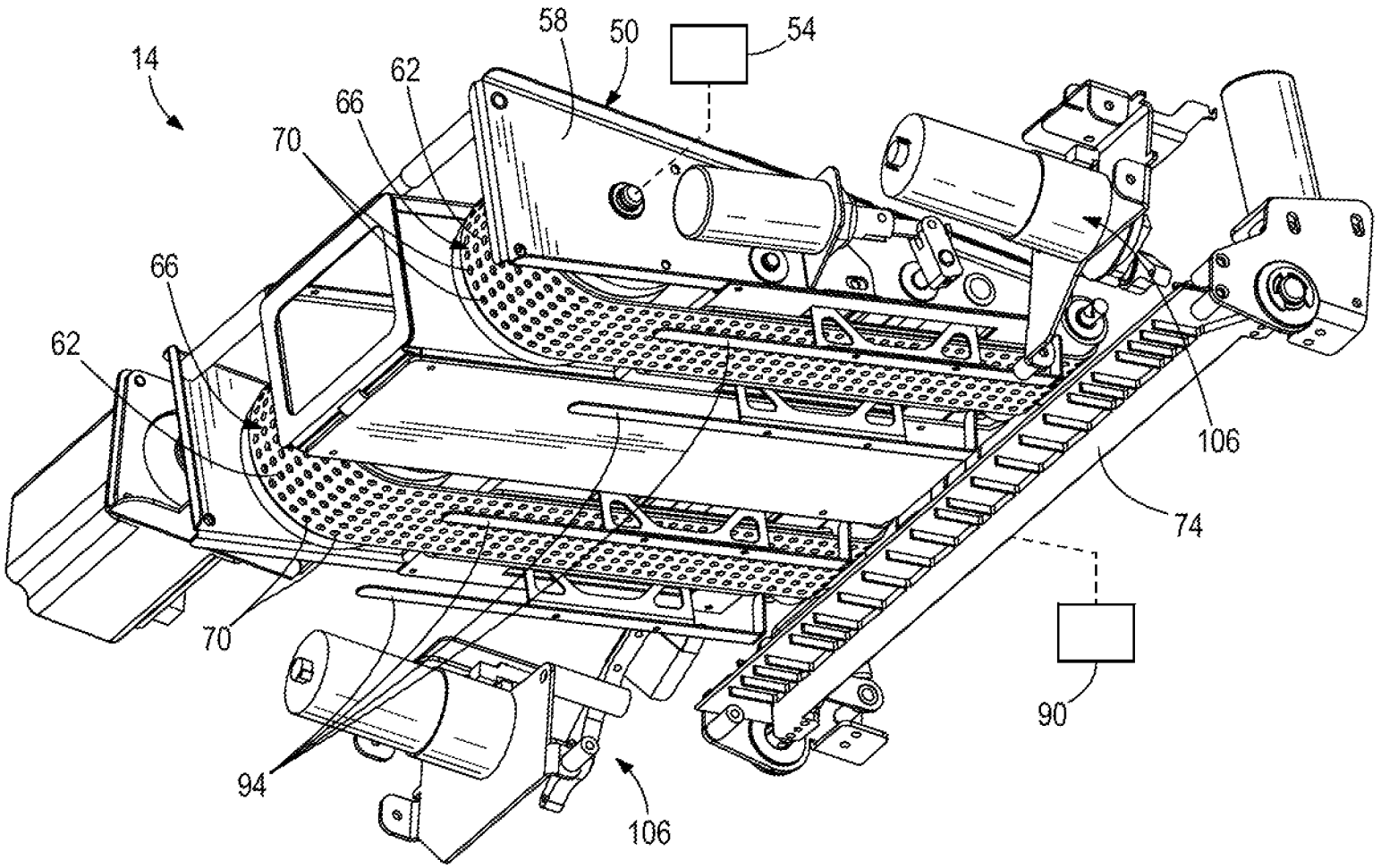
FIG. 2 is a perspective view of the sheet stacking device of FIG. 1, illustrating a vacuum system.
Figure 3:
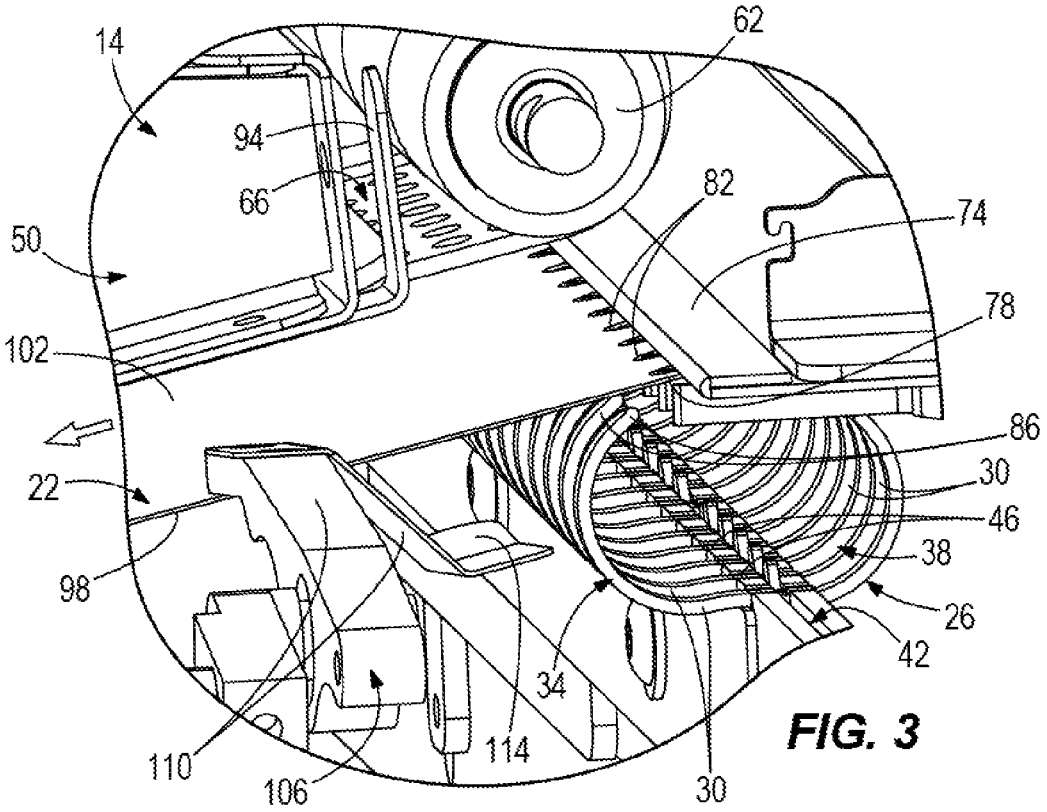
FIG. 3 is a perspective view of the sheet stacking device, illustrating a first sheet being delivered to a binder element with the vacuum system, and a sheet kick-down element and pressing element being arranged in first positions.

With reference to FIG. 2, the sheet stacking device 14 includes a vacuum system 50 that receives the sheet 22 (e.g., directly from a printer or other machine, or from a tray or other storage compartment within the machine 10) and moves the sheet 22 over the top of the binder element 26 in a direction as illustrated by the arrow in FIG. 3. The vacuum system 50 includes a vacuum source 54 (illustrated schematically in FIG. 2) and a body 58 in fluid communication with the vacuum source 54. The vacuum system 50 also includes rollers 62 coupled to the body 50, and two circulating belts 66 coupled to the rollers 62. The belts 66 include a plurality of apertures 70 that are in fluid communication with the vacuum source 54 and body 58. The sheet 22 is held by suction to the belts 66 through the apertures 70 as the belts 66 circulate. The illustrated construction includes two belts 66 that circulate parallel relative to one another. In other constructions the number and arrangement of belts 66 is different. For example, in some constructions a single belt 66 is used, whereas in other constructions three or more belts 66 are used. In some constructions, a system other than a vacuum system 50 (e.g., a roller system) is used to deliver the individual sheet 22.

With continued reference to FIGS. 2-14, the sheet stacking device 14 further includes a sheet deflector element 74. The sheet deflector element 74 is disposed adjacent the binder element 26. The sheet deflector element 74 extends in an elongate direction generally transverse to the direction of travel (as illustrated by the arrow in FIG. 3) of the sheet 22. The sheet 22 passes under the sheet deflector element 74 as the sheet 22 moves toward the vacuum source 50. The sheet deflector element 74 then presses the end 78 of the sheet 22 onto the binder element 26.

With reference to FIG. 3, the sheet 22 includes a plurality of apertures 82 along the end 78. The apertures 82 are formed by a paper punching machine or other similar machine prior to receipt of the sheet 22 by the sheet stacking device 14. As the end 78 of the individual sheet 22 passes over the prongs 30 on the first loop 34, by virtue of conveyance on the belts 66, the apertures 82 become aligned with ends 86 of the prongs 30.

Figure 4:
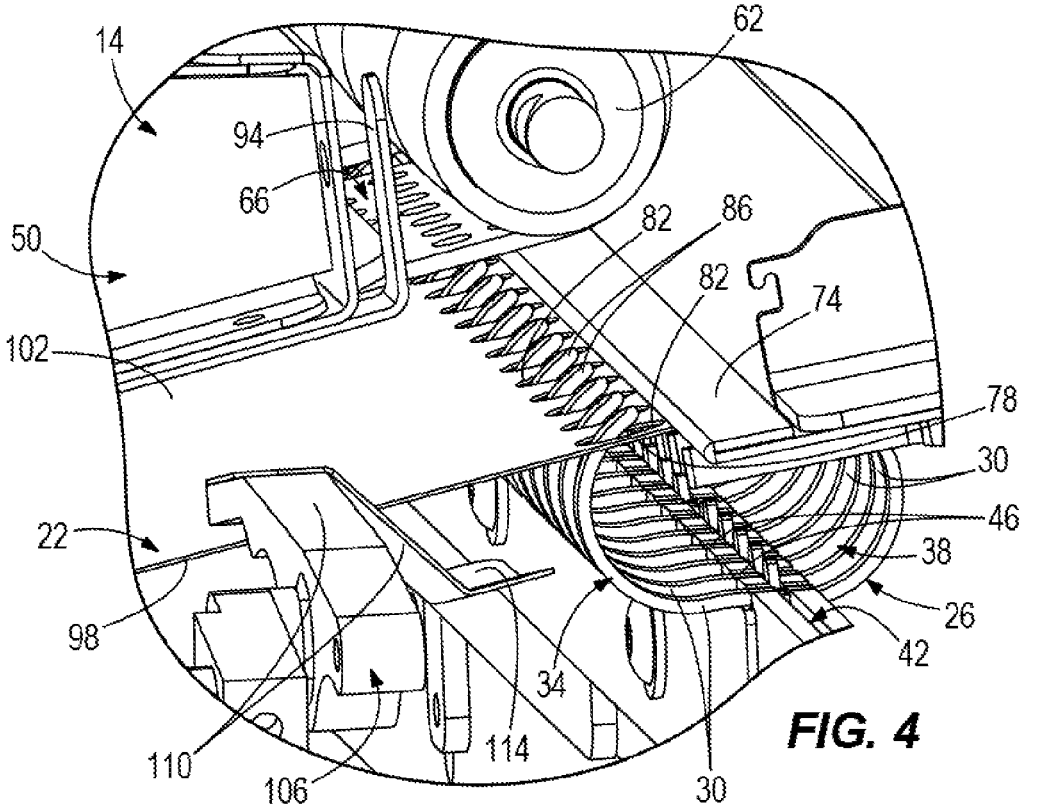
FIG. 4 is a perspective view of the sheet stacking device, illustrating a sheet deflector pressing an end of the first sheet over the binder element.

With reference to FIG. 4, once the apertures 82 are aligned with the ends 86, the sheet deflector element 74 moves down in a direction away from the vacuum system 50 and presses the end 78 of the sheet 22, causing the apertures 82 to slide over the ends 86 of the prongs 30. The binder element 26 remains stationary as the sheet 20 is coupled to the binder element 26. In the illustrated construction the vacuum system 50 remains on at all times during stacking of the sheet 22 and any subsequent sheets onto the binder element 26. In other constructions the vacuum system 50 is turned off intermittently between delivery of sheets.

The sheet stacking device 14 also includes one or more position sensors 90 (illustrated schematically in FIG. 2) in communication with the sheet deflector element 74 for determining when the apertures 82 are aligned with the ends 86. In some constructions the sheet stacking device 14 relies on a mechanical stop or stops and/or a timer or timers (not illustrated) to position the apertures 82 into alignment with the ends 86. Other constructions include different manners by which the sheet stacking device 14 determines that the apertures 82 are aligned with the ends 86.

With reference to FIGS. 2-14, the sheet stacking device 14 further includes a plurality of sheet kick-down elements 94 that press the sheet 22 away from the vacuum system 50 after the apertures 82 have been moved over the ends 86 of the prongs 30. The illustrated construction includes four sheet kick-down elements 94, two of the sheet kick-down elements 94 being disposed between the two circulating belts 66, and two of the kick-down elements 94 being disposed exterior of the two circulating belts 66. Each of the sheet kick-down elements 94 extends in an elongate direction generally parallel to the direction of travel (as illustrated in FIG. 3) of the individual sheet 22. Each of the sheet kick-down elements 94 is movable from a first position proximal one of the circulating belts 66 (as illustrated in FIG. 3) to a second position distal the circulating belt 66 (as illustrated in FIG. 6).

Figure 5:
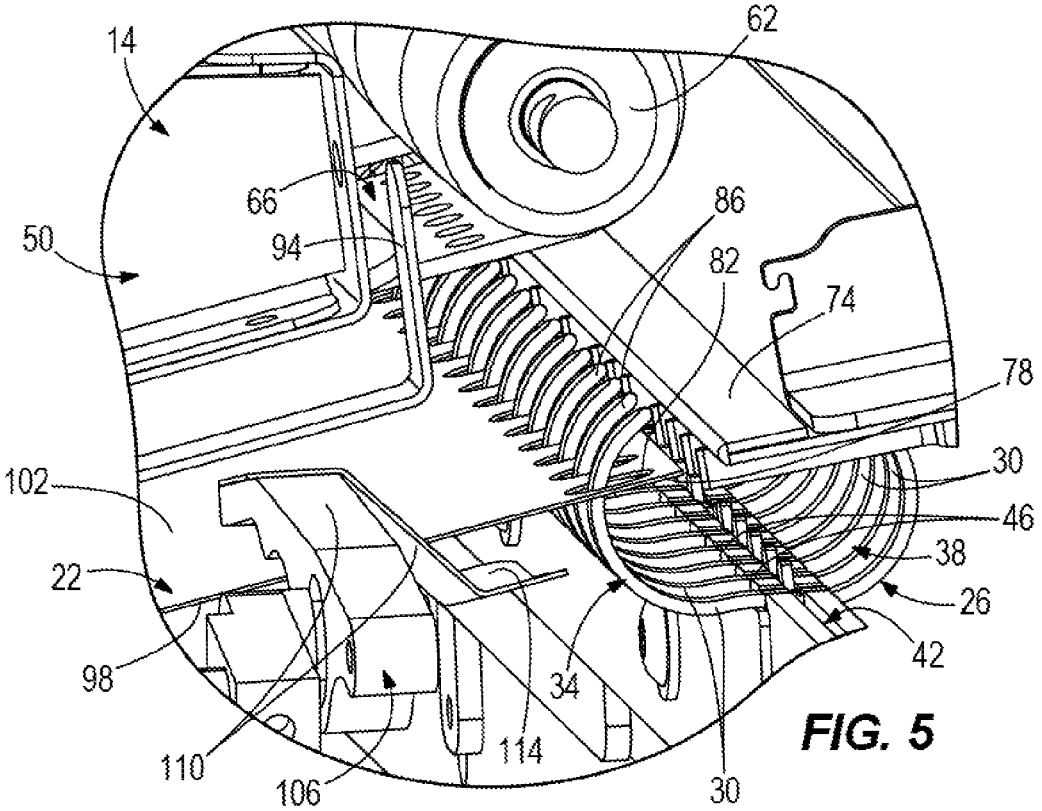
FIG. 5 is a perspective view of the sheet stacking device, illustrating the sheet kick-down element moving from the first position and pressing down on the first sheet.
Figure 6:
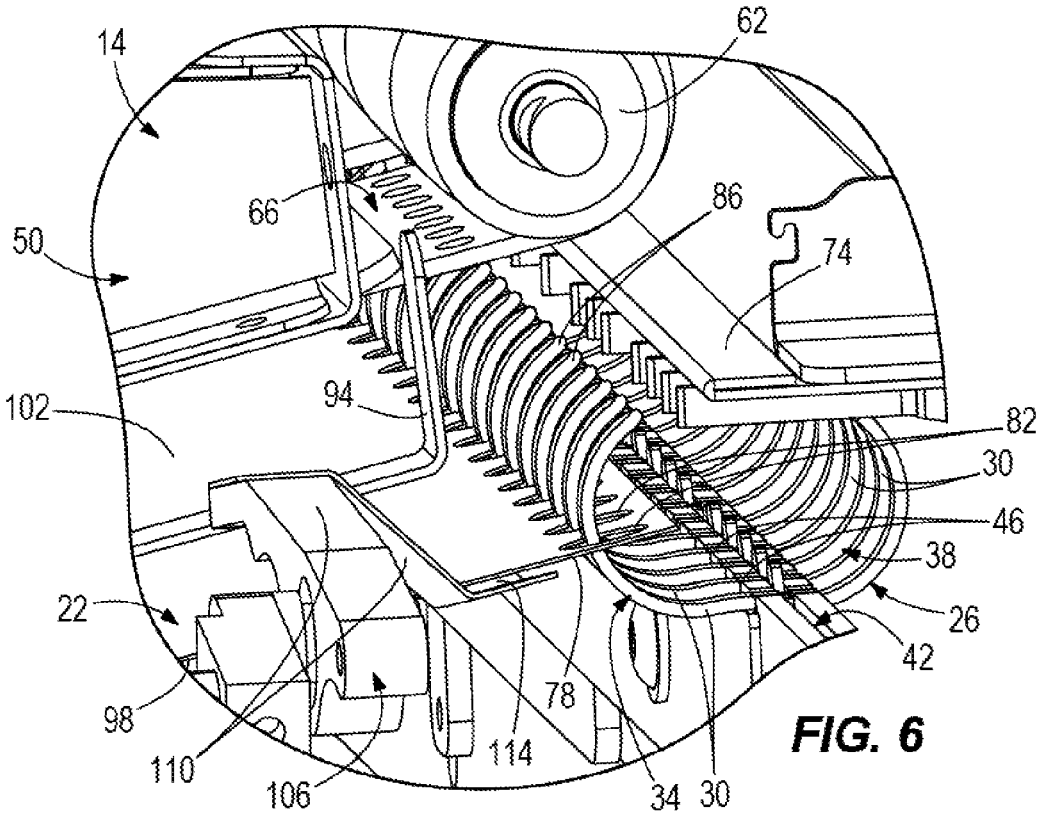
FIG. 6 is a perspective view of the sheet stacking device, illustrating the sheet kick-down element in a second position.

With reference to FIGS. 5 and 6, once the apertures 82 have been moved over the ends 86 of the prongs 30 with the sheet deflector element 74, the sheet kick-down elements 94 move from the first position toward the individual sheet 22. The sheet kick-down elements 94 engage the sheet 22 along side edges 98 of the sheet 22, as well as in a middle portion 102 of the sheet 22, and press the sheet 22 away from the vacuum system 50, until the sheet kick-down elements 94 reach the second position. During movement from the first position to the second position the apertures 82 on the sheet 22 slide farther down along the prongs 30 of the first loop 34.

While four sheet kick-down elements 94 are illustrated, in other constructions different numbers of kick-down elements 94 are used, as are different locations for the sheet kick-down elements 94.

Figure 7:
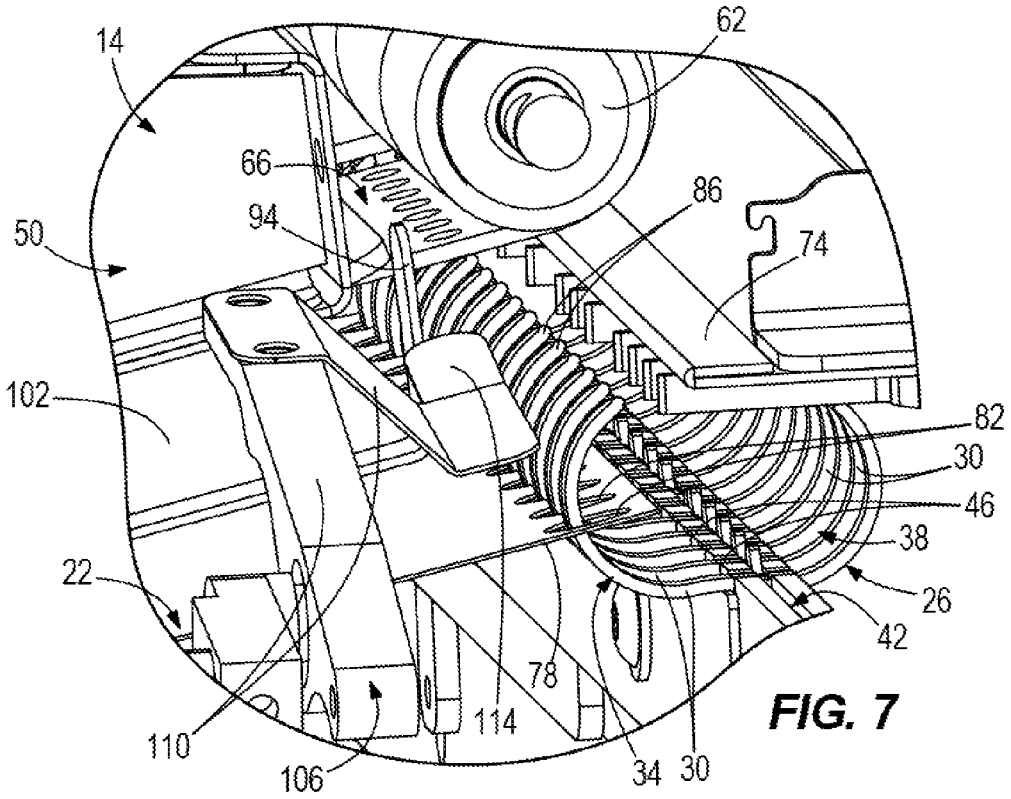
FIG. 7 is a perspective view of the sheet stacking device, illustrating the pressing element moving from the first position toward a second position.
Figure 8:
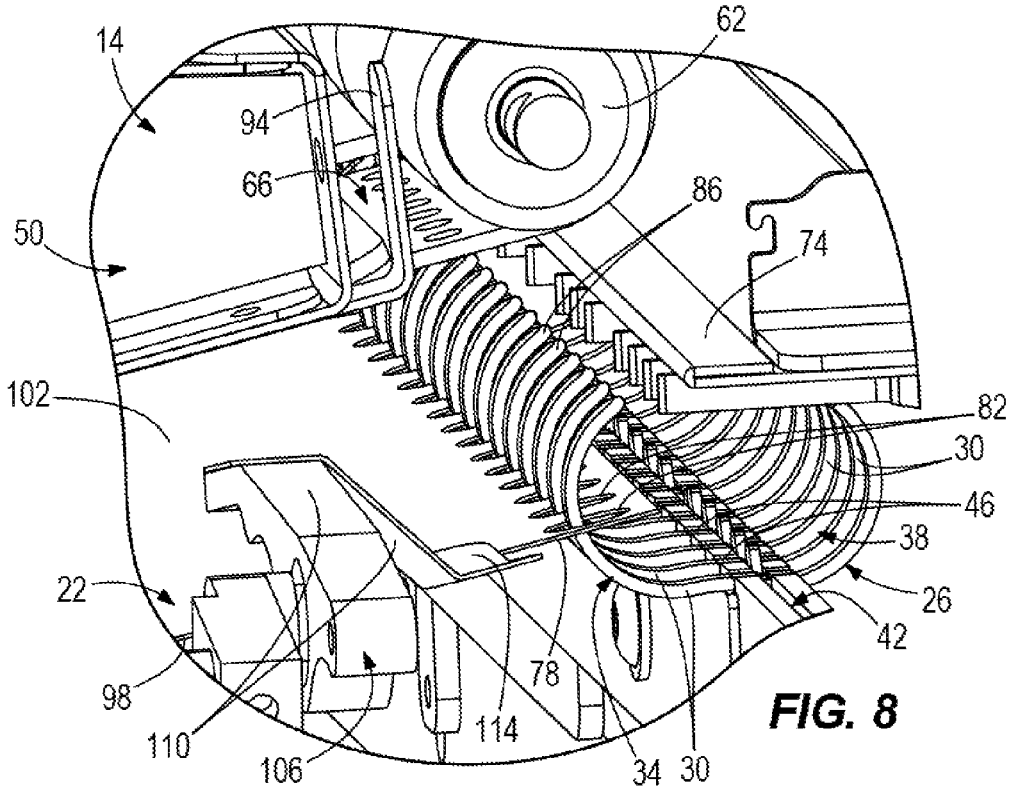
FIG. 8 is a perspective view of the sheet stacking device, with the pressing element in the second position, and the sheet kick-down element having returned to the first position.

With reference to FIGS. 2-14, the illustrated sheet stacking device 14 further includes a plurality of pressing elements 106. The pressing elements 106 restrain the individual sheet 22 after the sheet kick-down elements 94 have moved from the first position to the second position. The illustrated construction includes two pressing elements 106, each pressing element 106 disposed adjacent to and on an exterior side of one of the circulating belts 66. Each of the pressing elements 106 moves from a first position generally underneath the sheet 22 (as illustrated in FIG. 6) to a second position generally above the sheet 22 (as illustrated in FIG. 8), the first position being farther away from the vacuum system 50 than the second position. As illustrated in FIG. 7, during movement from the first position of the pressing elements 106 to the second position of the pressing elements 106, the pressing elements 106 swing out and away from the sheet 22 in an arcuate manner in order to move from underneath the sheet 22 to above the sheet 22, before moving directly down in a linear manner onto the sheet 22. The pressing elements 106 include a plurality of linkages 110, as well as pressing portions 114 that contact and press against the sheet 22. Each pressing portion 114 is angled such that it presses both down on the sheet 22 (i.e., in a direction away from the vacuum system 50), as well as laterally against the side edge 98 (i.e., in a direction toward the middle portion 102 of the sheet 22) in the second position of the pressing elements 106. The pressing portions 114 help to restrain the sheet 22 both laterally and vertically, and prevent the apertures 82 from sliding back up the prongs 30.

In the illustrated construction, movement of the pressing elements 106 from the first position of the pressing elements 106 to the second position of the pressing elements 106 occurs while the sheet kick-down elements 94 are engaged with the sheet 22 in the second position of the sheet kick-down elements 94. In other constructions the movement of the pressing elements 106 occurs at a different time.

With reference to FIG. 8, once the pressing portions 114 have engaged the sheet 22 in the second position of the pressing elements 106, the sheet kick-down elements 94 are then moved away from the sheet 22 and back to the first position of the sheet kick-down elements 94 (i.e., in a position proximal the belts 66).

With reference to FIGS. 9-14, once the sheet kick-down elements 94 have returned to the first position of the sheet kick-down elements 94, the pressing elements 106 remain on top of the sheet 22, and a second sheet 122 is received and moved by the vacuum system 50 toward binder element 26.

Figure 9:
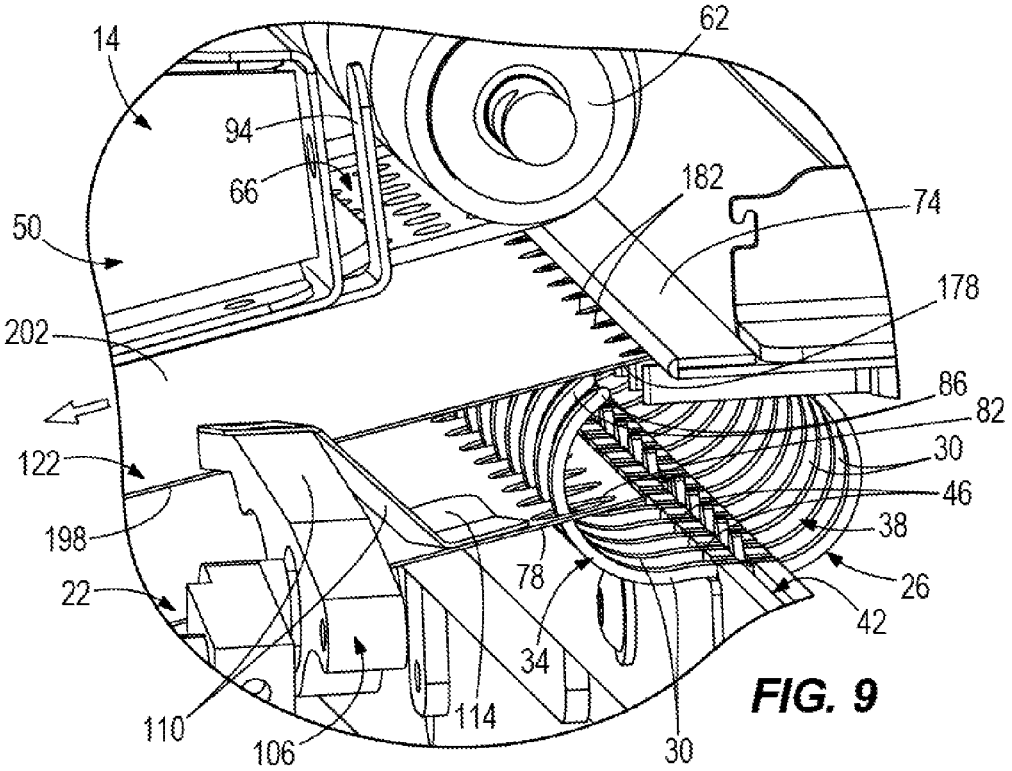
FIG. 9 is a perspective view of the sheet stacking device, illustrating a second sheet being delivered to the binder element, and the sheet kick-down element and pressing element again being in the first positions.
Figure 10:
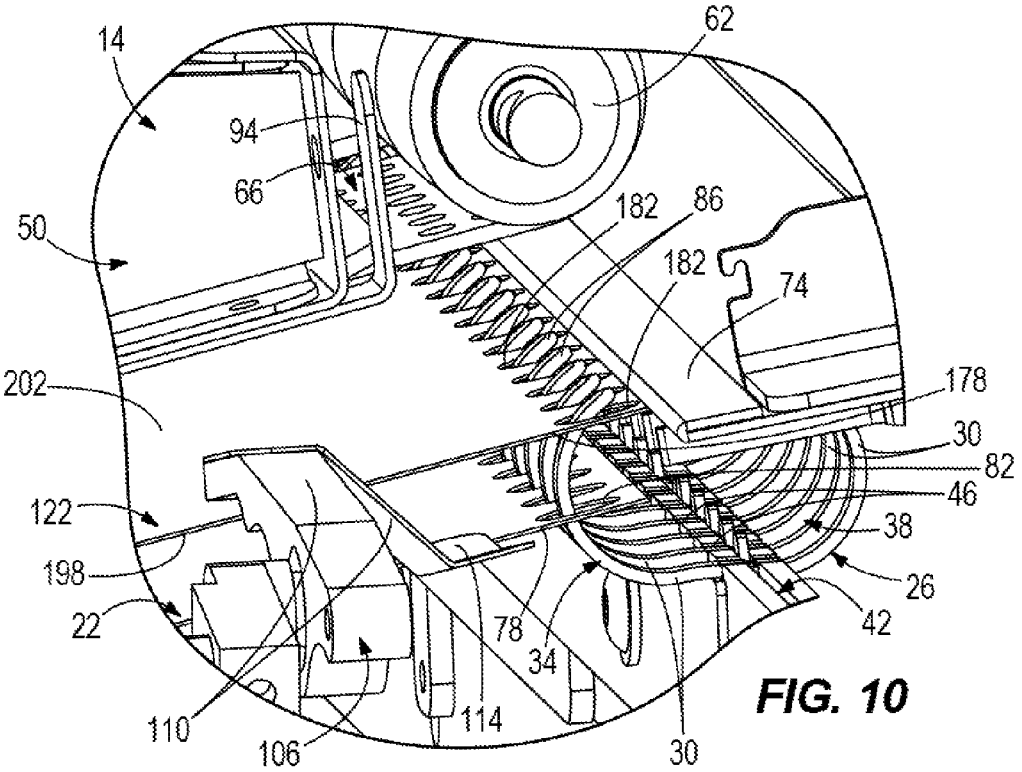
FIG. 10 is a perspective view of the sheet stacking device, illustrating the sheet deflector pressing an end of the second sheet over the binder element.

The second sheet 122 is typically identical in size and shape to the sheet 22 described above. With reference to FIG. 9, as the second sheet 122 approaches the binder element 26, an end 178 of the second sheet 122 passes over the prongs 30 on the first loop 34, and apertures 182 in the second sheet 122 become aligned with the ends 86 of the prongs 30, in an identical manner as the sheet 22. As illustrated in FIG. 10, once the apertures 182 are aligned with the ends 86, the sheet deflector element 74 moves down, in a direction away from the vacuum system 50, to press the end 178 of the second sheet 22 and cause the apertures 182 to slide over the ends 86 of the prongs 30.

Figure 11:
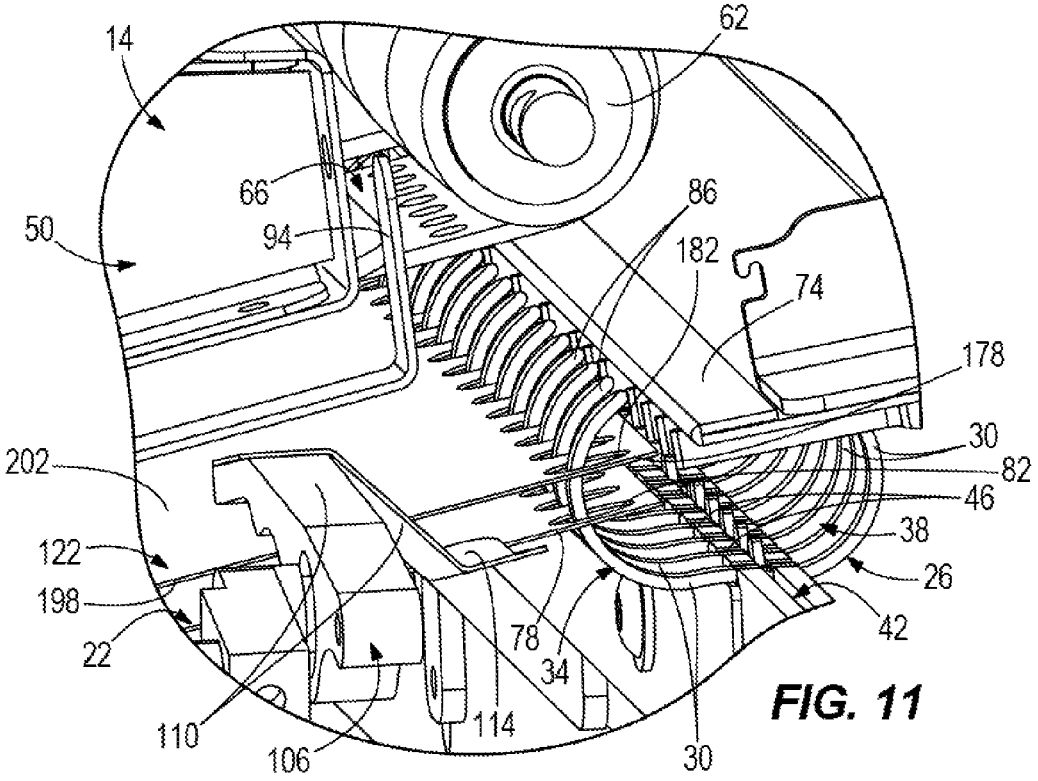
FIG. 11 is a perspective view of the sheet stacking device, illustrating the sheet kick-down element moving from the first position and pressing down on the second sheet.
Figure 12:
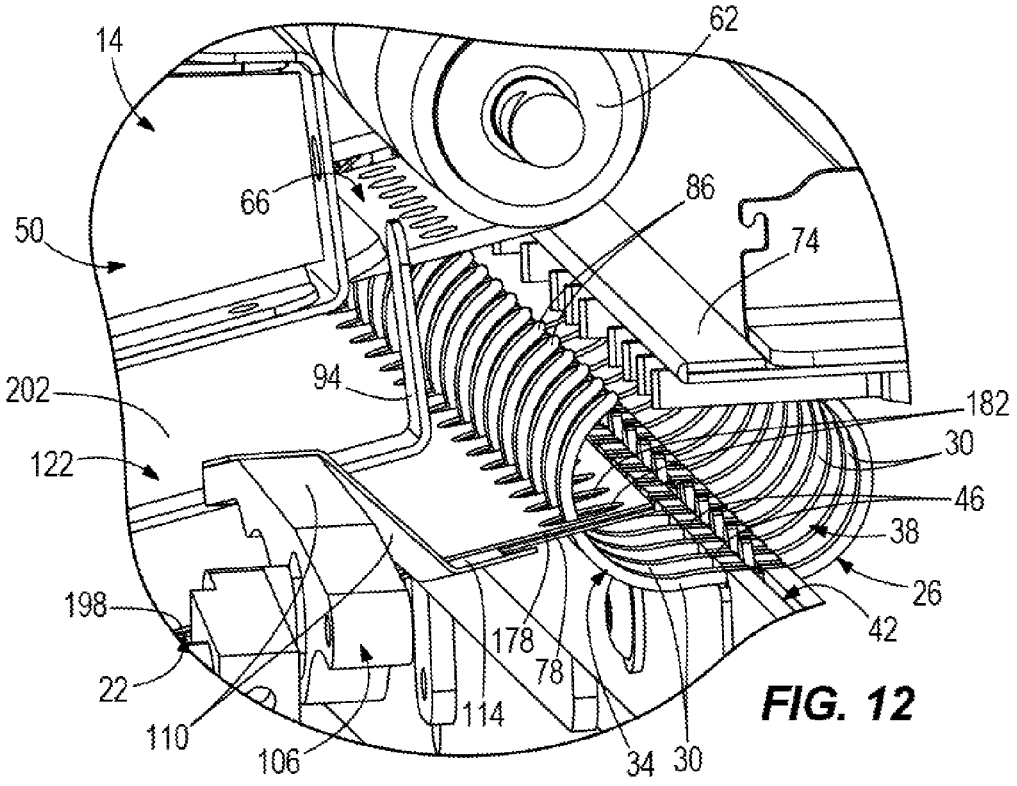
FIG. 12 is a perspective view of the sheet stacking device, illustrating the sheet kick-down element in the second position.

With reference to FIGS. 11 and 12, once the apertures 182 have been moved over the ends 86 of the prongs 30, the sheet kick-down elements 94 are then moved from the first position of the sheet kick-down elements 94 to the second position of the sheet kick-down elements 94. The sheet kick-down elements 94 engage the second sheet 122 along side edges 198 of the second sheet 22, as well as in a middle portion 202 of the second sheet 122, and press the second sheet 122 away from the vacuum system 50. As the second sheet 122 is pressed away from the vacuum system 50, the second sheet 122 approaches the sheet 22.

Figure 13:
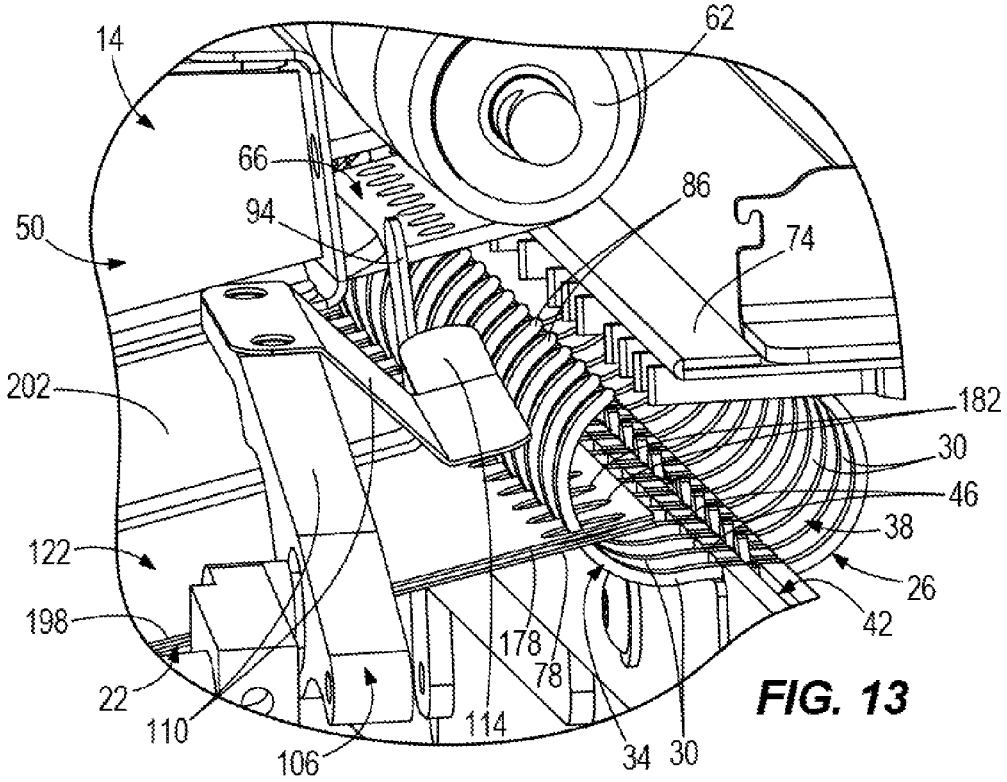
FIG. 13 is a perspective view of the sheet stacking device, illustrating the pressing element moving from the first position toward the second position.
Figure 14:
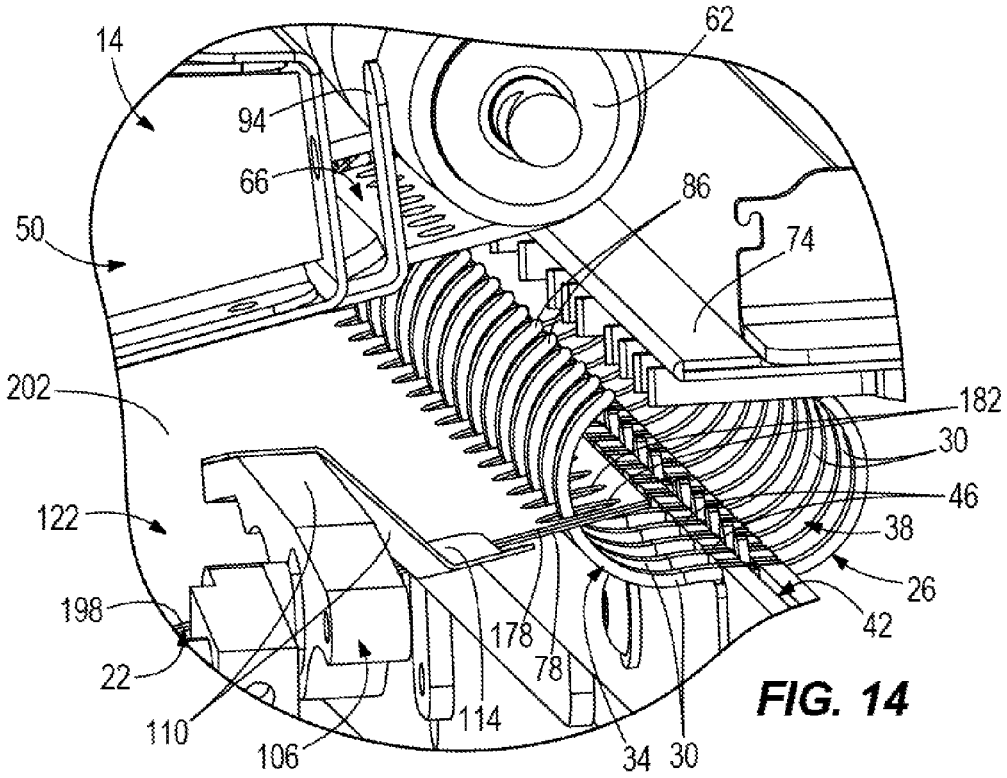
FIG. 14 is a perspective view of the sheet stacking device, with the pressing element in the second position, and the sheet kick-down element having returned to the first position.

With reference to FIGS. 13 and 14, once the second sheet 122 has been pressed down by the sheet kick-down elements 94, the pressing elements 106 are then moved from the second position of the pressing elements 106 to a third position of the pressing elements 106 above the second sheet 122, such that the pressing portions 114 engage a top of the second sheet 122 and press down on a combined stack of both the second sheet 122 and the sheet 22. Similar to the movement from the first position to the second position, the movement from the second position to the third position also includes an arcuate movement, wherein the pressing elements 106 swing out and then up toward the vacuum system 50 before coming back down to rest on the sheets 22, 122.

With the two sheets 22, 122 stacked and coupled to the binder element 26, the process continues to repeat, adding further sheets to the binder element 26 as desired, with the pressing elements 106 moving up each time to successive positions in order to press down upon the full stack of sheets. In some constructions, as the sheets are stacked and coupled to the binder element 26, the sheets are held up and supported with a support structure (not shown), such that when the pressing elements 106 move to the second, third, etc. positions of the pressing elements 106, the sheets do not fall away from the vacuum system 50. When the pressing elements 106 are in the initial first position of the pressing elements 106, the pressing portions 114 provide added support for the full stack of sheets.

In some constructions the sheet stacking device 14 operates without the pressing elements 106. For example, in some constructions the sheet stacking device relies on the sheet kick-down elements 94 themselves to press the sheets 22, 122, etc. into a stacked formation. In other constructions, however, the sheets 22, 122, etc. generate static and stick to one another, curl, etc. In these constructions the pressing elements 106 help to hold the sheets 22, 122, etc. down while the sheet kick-down elements 94 are raised and pulled away from the sheets 22, 122, etc.

While the first and second sheets 22 and 122 described above are identical in size and material, in some constructions the second sheet 122 is a different size or material than the sheet 22. For example, in some constructions the second sheet 122 is a divider page of a booklet, made of a stiffer material than the sheet 22.

Once the sheets have been stacked, the binder element 26 is then closed. The first and second loops 34, 38 are forced together (e.g. with a pinching or pressing device not shown), such that the stack of sheets is bound. The bound stack of sheets and binder element 26 are then removed from the machine 10, and another binder element 26 is moved to the binder holding device 42. Other binder elements 26 have other types of closing structures and methods of closing the binder element.

Various features and advantages of the invention are set forth in the following claims.

What is claimed is:

1. A binding machine comprising:
- a housing;
- a binder element disposed in the housing;
- a sheet stacking device disposed within the housing, the sheet stacking device comprising:
  - a vacuum system that delivers an individual sheet toward the binder element;
  - a sheet deflector element that presses an end of the individual sheet onto the binder element; and
  - a sheet kick-down element that presses the individual sheet away from the vacuum system.

2. The binding machine of claim 1, wherein the vacuum system includes both a body in fluid communication with a vacuum source and a circulating belt coupled to the body.

3. The binding machine of claim 2, wherein the belt includes a plurality of apertures in fluid communication with the vacuum source.

4. The binding machine of claim 2, wherein the sheet stacking device includes two circulating belts and a plurality of kick-down elements, one of the kick-down elements disposed between the two circulating belts.

5. The binding machine of claim 4, wherein the sheet stacking device includes four sheet kick-down elements, two of the kick-down elements disposed between the two circulating belts.

6. The binding machine of claim 1, wherein the sheet kick-down element is movable from a first position proximal the vacuum system to a second position distal the vacuum system.

7. The binding machine of claim 1, wherein the sheet kick-down element is an elongate element extending in a first direction and the sheet deflector is an elongate element extending in a second direction, the second direction being transverse to the first direction.

8. The binding machine of claim 1, further comprising a pressing element that restrains the individual sheet.

9. The binding machine of claim 8, wherein the sheet stacking device includes two pressing elements and the vacuum system includes two circulating belts, each of the two pressing elements disposed adjacent an exterior side of one of the circulating belts.

10. The binding machine of claim 8, wherein the pressing element is movable from a first position underneath the individual sheet when the individual sheet has been pressed onto the binder element to a second position above the individual sheet when the individual sheet has been pressed onto the binder element, the second position being closer to the vacuum system than the first position.

11. The binding machine of claim 10, wherein the movement from the first position to the second position includes arcuate movement.

12. The binding machine of claim 10, wherein the pressing element is movable from the second position to a third position above a second sheet when the second sheet has been pressed onto the binder element, the third position being closer to the vacuum system than the second position.

13. The binding machine of claim 12, wherein the movement from the second position to the third position includes arcuate movement.

14. The binding machine of claim 8, wherein the pressing element includes a plurality of linkages.

15. The binding machine of claim 8, wherein the pressing element includes a pressing portion that is angled to press both down on the individual sheet in a direction away from the vacuum system, as well as laterally against a side edge of the individual sheet.

16. A binding machine comprising:

a housing;

a binder element disposed in the housing;

a sheet stacking device disposed within the housing, the sheet stacking device comprising:

a vacuum system that delivers an individual sheet toward the binder element, wherein the vacuum system includes both a body in fluid communication with a vacuum source and a circulating belt coupled to the body;

a sheet deflector element that presses an end of the individual sheet onto the binder element;

a sheet kick-down element that presses the individual sheet away from the vacuum system, wherein the sheet kick-down element is movable from a first position proximal the vacuum system to a second position distal the vacuum system; and a pressing element that restrains the individual sheet.

17. The binding machine of claim 16, wherein the sheet kick-down element is an elongate element extending in a first direction and the sheet deflector is an elongate element extending in a second direction, the second direction being transverse to the first direction.

18. The binding machine of claim 16, wherein the sheet stacking device includes two pressing elements and the vacuum system includes two circulating belts, each of the two pressing elements disposed adjacent an exterior side of one of the circulating belts.

19. The binding machine of claim 16, wherein the pressing element is movable from a first position underneath the individual sheet when the individual sheet has been pressed onto the binder element to a second position above the individual sheet when the individual sheet has been pressed onto the binder element, the second position being closer to the vacuum system than the first position.

20. The binding machine of claim 19, wherein the pressing element is movable from the second position to a third position above a second sheet when the second sheet has been pressed onto the binder element, the third position being closer to the vacuum system than the second position.

21. The binding machine of claim 16, wherein the pressing element includes a pressing portion that is angled to press both down on the individual sheet in a direction away from the vacuum system, as well as laterally against a side edge of the individual sheet.

* * * * *